US009858812B2

(12) United States Patent
Matsuoka et al.

(10) Patent No.: US 9,858,812 B2
(45) Date of Patent: Jan. 2, 2018

(54) TRAFFIC SIGNAL STATE DETECTION APPARATUS

(71) Applicant: TOYOTA JIDOSHA KABUSHIKI KAISHA, Toyota-shi, Aichi-ken (JP)

(72) Inventors: Katsuhiro Matsuoka, Nagakute (JP); Kazuhiro Morimoto, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 45 days.

(21) Appl. No.: 14/922,876

(22) Filed: Oct. 26, 2015

(65) Prior Publication Data

US 2016/0133129 A1 May 12, 2016

(30) Foreign Application Priority Data

Nov. 6, 2014 (JP) ..... 2014-226319

(51) Int. Cl.
*G08G 1/096* (2006.01)
*G08G 1/0967* (2006.01)
(Continued)

(52) U.S. Cl.
CPC ..... *G08G 1/096* (2013.01); *G08G 1/093* (2013.01); *G08G 1/095* (2013.01);
(Continued)

(58) Field of Classification Search
CPC .. G08G 1/096; G08G 1/093; G08G 1/096716; G08G 1/775; G08G 1/096783
See application file for complete search history.

(56) References Cited

U.S. PATENT DOCUMENTS 5,745,865 A * 4/1998 Rostoker ..... G01S 5/06 455/456.5
5,973,616 A * 10/1999 Grebe ..... G08G 1/087 340/12.29
(Continued)

FOREIGN PATENT DOCUMENTS

EP 2618320 A1 * 7/2013 ..... G08G 1/087
JP 2013-105200 A 5/2013
WO 2009/157108 A1 12/2009

*Primary Examiner* — Daniell L Negron
(74) *Attorney, Agent, or Firm* — Oliff PLC

(57) ABSTRACT

A traffic signal state detection apparatus includes a first traffic signal information obtaining part that obtains first traffic signal information generated by a first infrastructure, a first output process part configured to calculate, based on the first traffic signal information from the first traffic signal information obtaining part, a second traffic signal information obtaining part that obtains second traffic signal information generated by a second infrastructure that is different from the first infrastructure, a second output process part that calculates, based on the second traffic signal information from the second traffic signal information obtaining part, and an output part that outputs one of the first and second remaining times in a situation where the first and second output demands are generated simultaneously, the output remaining time being related to one of the first and second output demands that is being continuously generated before the other is generated.

11 Claims, 5 Drawing Sheets

(51) Int. Cl.
*G08G 1/095* (2006.01)
*G08G 1/09* (2006.01)

(52) U.S. Cl.
CPC . *G08G 1/096716* (2013.01); *G08G 1/096775* (2013.01); *G08G 1/096783* (2013.01)

(56) References Cited

U.S. PATENT DOCUMENTS 6,958,707 B1 * 10/2005 Siegel ..... G08G 1/087 340/435
7,113,108 B1 * 9/2006 Bachelder ..... G08G 1/087 340/906
8,135,952 B2 * 3/2012 Bretheim ..... H04L 9/3271 713/168
8,373,578 B1 * 2/2013 Sikora ..... G08G 1/087 340/901
8,599,041 B2 * 12/2013 Lim ..... G08G 1/081 340/901
9,111,445 B1 * 8/2015 Pashel ..... G08G 1/087
2004/0196162 A1 * 10/2004 Brooke ..... G08G 1/20 340/906
2010/0141477 A1 * 6/2010 Lim ..... G08G 1/081 340/906
2011/0093178 A1 4/2011 Yamada et al.
2011/0205086 A1 * 8/2011 Lamprecht ..... G08G 1/08 340/928
2011/0254702 A1 10/2011 Yamada
2012/0112927 A1 * 5/2012 Grieco ..... G08G 1/04 340/906
2012/0146814 A1 * 6/2012 Kim ..... G08G 1/164 340/929
2012/0166072 A1 6/2012 Tamaoki et al.
2013/0135117 A1 5/2013 Morimoto
2014/0278026 A1 * 9/2014 Taylor ..... G08G 1/08 701/117
2014/0278029 A1 * 9/2014 Tonguz ..... G08G 1/087 701/117
2015/0046055 A1 2/2015 Yamada et al.
2015/0243165 A1 * 8/2015 Elsheemy ..... B60R 25/00 340/906
2015/0262483 A1 * 9/2015 Sugawara ..... G08G 1/0962 340/929
2015/0310737 A1 * 10/2015 Simanowski ..... G08G 1/081 340/910
2015/0371538 A1 * 12/2015 Eichhorst ..... G08G 1/087 340/906
2016/0055744 A1 * 2/2016 Branson ..... G08G 1/07 340/916
2016/0253903 A1 * 9/2016 Wilk ..... G08G 1/087

* cited by examiner

TRAFFIC SIGNAL STATE DETECTION APPARATUS

FIELD

The present invention is related to a traffic signal state detection apparatus that outputs a remaining time of a red traffic signal to a driver of a host vehicle.

BACKGROUND

A drive support apparatus includes a part that obtains a traffic signal information related to a light state of traffic signal in time series, and a first output part that outputs to a driver a remaining time before a light state of the traffic signal is changed to a driver (see WO2009/157108 pamphlet which is referred to as "Patent Document 1" hereinafter).

There are infrastructures that provide information to vehicles such as an infrastructure that utilizes optical communication and an infrastructure that utilizes electric wave communication. If the traffic signal information can be obtained from such infrastructures, even when one infrastructure cannot be used at a certain intersection, the remaining time of the red traffic signal can be output to the driver of the host vehicle using another infrastructure. However, when the traffic signal information can be obtained from two or more infrastructures at a certain intersection, output demands between output process parts that are operated based on the respective items of the traffic signal information are in competition against one another. Such competition demands may cause the driver to feel strange if the respective demands are responded normally.

Therefore, an object of the present invention is to provide a traffic signal state detection apparatus that can perform arbitration between output process parts that are operated based on respective items of traffic signal information from different infrastructures.

SUMMARY

According to one aspect of the present invention, a traffic signal state detection apparatus is provided, which comprises:

a first traffic signal information obtaining part configured to obtain first traffic signal information generated by a first infrastructure, the first traffic signal information representing a change in a light state of a traffic signal in time series, the traffic signal being located ahead of a host vehicle;

a first output process part configured to calculate, based on the first traffic signal information obtained by the first traffic signal information obtaining part, a first remaining time before a timing when the light state of the traffic signal is to be changed from a current predetermined first state to a second predetermined state that is different from the first state, and generate a first output demand for outputting the calculated first remaining time;

a second traffic signal information obtaining part configured to obtain second traffic signal information generated by a second infrastructure that is different from the first infrastructure, the second traffic signal information representing the change in the light state of the traffic signal in time series;

a second output process part configured to calculate, based on the second traffic signal information obtained by the second traffic signal information obtaining part, a second remaining time before the timing when the light state of the traffic signal is to be changed from the current predetermined first state to the second predetermined state, and generate a second output demand for outputting the calculated second remaining time; and an output part configured to output one of the first and second remaining times in a situation where the first and second output demands are generated simultaneously, the output remaining time being related to one of the first and second output demands that is being continuously generated before the other is generated

DESCRIPTION OF EMBODIMENTS

In the following, embodiments will be described with reference to the accompanying drawings.

Figure 1:
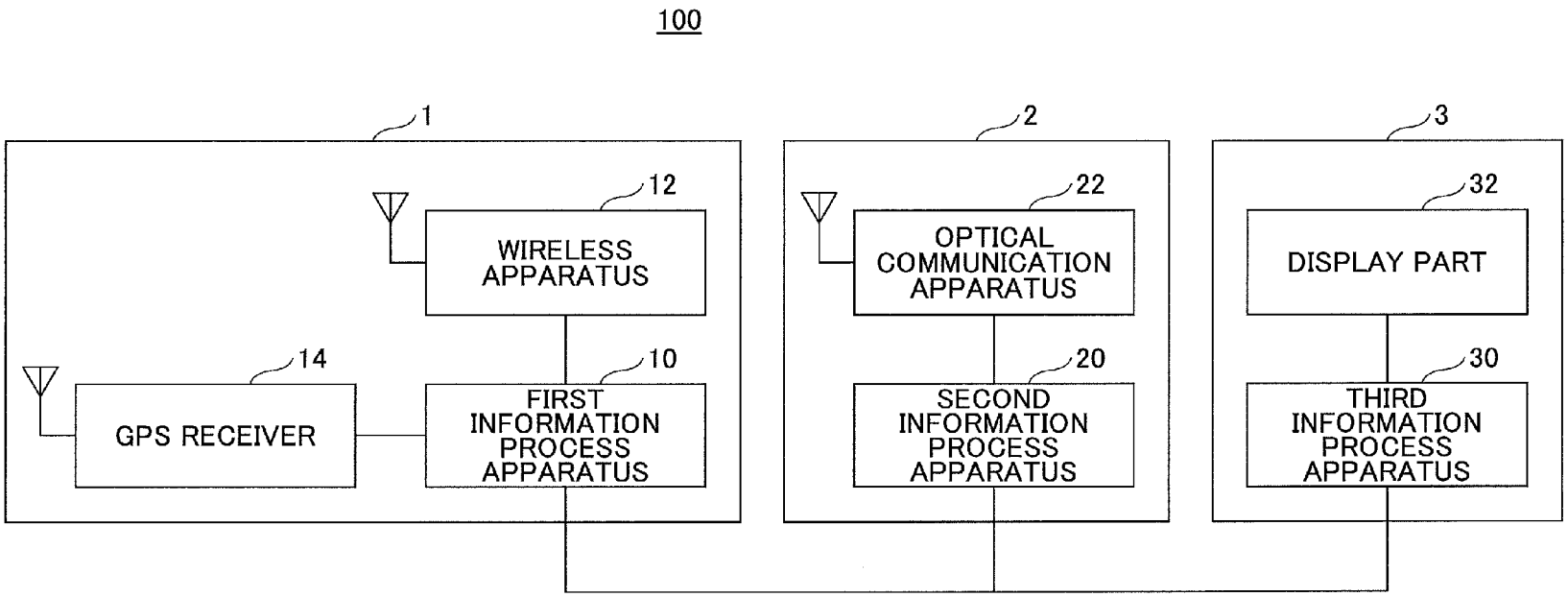
FIG. 1 is a diagram illustrating a configuration of a traffic signal state detection apparatus 100 according to a first embodiment of the present invention.

FIG. 1 is a diagram illustrating a configuration of a traffic signal state detection apparatus 100 according to a first embodiment of the present invention.

The traffic signal state detection apparatus 100 is installed on a vehicle. The traffic signal state detection apparatus 100 includes a wireless control apparatus 1, a navigation apparatus 2, and a meter display apparatus (an example of an output part) 3. In the following, a vehicle on which the traffic signal state detection apparatus 100 is installed is referred to as "a host vehicle".

The wireless control apparatus 1 includes a first information process apparatus (an example of a first output process part) 10, a wireless communication apparatus (an example of a first traffic signal information obtaining part) 12, and a GPS (Global Positioning System) receiver 14.

The processing device 10 is formed of a computer.

The first information process apparatus 10 performs a first output process at a first predetermined cycle $\Delta T1$ during a period in which a first output condition is met. The first information process apparatus 10 sets the first flag to "1" during the period in which a first output condition is met. The first output condition is met when a first output start condition is met, and the first output condition is in a met state until a first output end condition is met. The first output condition calculates, based on the latest first traffic signal information at that timing, a first remaining time (referred to as "a red signal remaining time T1", hereinafter) until the light state of the traffic signal is to be changed from a red signal (an example of a predetermined first state) to a blue signal (an example of a second predetermined state) to generate a first output demand for demanding the output of the red signal remaining time T1. The first output demand includes a value of the red signal remaining time T1.

The first output start condition is met when all the conditions (1) through (3) are met, for example:

(1) the current light state of the traffic signal based on the first traffic signal information is the red signal.

(2) the vehicle speed of the host vehicle is less than or equal to a predetermined value V1.

(3) the distance from the host vehicle to the traffic signal (or a stop sign before the traffic signal) related to the first traffic signal information is less than or equal to a predetermined distance D1.

The first output start condition is met when any one of conditions (11) through (13) is met, for example:

(11) the current light state of the traffic signal based on the first traffic signal information is no longer the red signal (or a predetermined second lapses after the timing at which the current light state of the traffic signal based on the first traffic signal information is no longer the red signal).

(12) the host vehicle starts to move (or the vehicle speed of the host vehicle is greater than a predetermined value V2).

(13) the host vehicle enters an intersection region related to the first traffic signal information.

The wireless communication apparatus 12 performs radio communication with a road side apparatus (an example of a first infrastructure) including a radio communication apparatus. A point where the radio communication is performed is before the intersection at which the information is to be output, for example. The wireless communication apparatus 12 obtains the first traffic signal information from the road side apparatus that generates the first traffic signal information. The first traffic signal information represents, in time series, a change in the light state of the traffic signal ahead of the host vehicle. Preferably, the first traffic signal information includes the information that can identify a cycle of the red signal. The first traffic signal information may further include information related to the intersection of the traffic signal ahead of the host vehicle. The information related to the intersection of the traffic signal may be coordinates of a center point of the intersection, traffic regulation information related to the intersection, road shape information of the intersection, etc.

The GPS receiver 14 calculates, based on signals from satellites, the position of the host vehicle (latitude, longitude, and azimuth, for example).

The navigation apparatus 2 includes a second information process apparatus 20 (an example of a second output process part) and an optical communication apparatus 22 (an example of a second traffic signal information obtaining part).

The second information process apparatus 20 is formed of a computer, as is the case with the first information process apparatus 10.

The second information process apparatus performs a second output process at a second predetermined cycle ΔT2 during a period in which a second output condition is met. The second predetermined cycle ΔT2 is the same as the first predetermined cycle ΔT1 or different from the first predetermined cycle ΔT1. The second information process apparatus 20 sets the second flag to "1" during the period in which a second output condition is met. The second output condition is met when a second output start condition is met, and the second output condition is in a met state until a second output end condition is met. The second output condition calculates, based on the latest second traffic signal information at that timing, a second remaining time (referred to as "a red signal remaining time T2", hereinafter) until the light state of the traffic signal is to be changed from a red signal (an example of a predetermined first state) to a blue signal (an example of a second predetermined state) to generate a second output demand for demanding the output of the red signal remaining time T2. The second output demand includes a value of the red signal remaining time T2.

The second output start condition is met when all the conditions (21) through (23) are met, for example:

(21) the current light state of the traffic signal based on the second traffic signal information is the red signal.

(22) the vehicle speed of the host vehicle is less than or equal to the predetermined value V1.

(23) the distance from the host vehicle to the traffic signal (or a stop sign before the traffic signal) related to the second traffic signal information is less than or equal to the predetermined distance D1.

The second output start condition is met when any one of conditions (31) through (33) is met, for example:

(31) the current light state of the traffic signal based on the second traffic signal information is no longer the red signal (or a predetermined second lapses after the timing at which the current light state of the traffic signal based on the second traffic signal information is no longer the red signal).

(32) the host vehicle starts to move (or the vehicle speed of the host vehicle is greater than a predetermined value V2).

(33) the host vehicle enters an intersection region related to the second traffic signal information.

The optical communication apparatus 22 performs optical communication with a road side apparatus (an example of a second infrastructure) including an optical beacon apparatus. A point where the radio communication is performed is before the intersection at which the information is to be output, for example. The optical communication apparatus 22 obtains the second traffic signal information from the road side apparatus that generates the second traffic signal information. The second traffic signal information represents, in time series, a change in the light state of the traffic signal ahead of the host vehicle. Preferably, the second traffic signal information includes the information that can identify a cycle of the red signal. The second traffic signal information may further include information related to the intersection of the traffic signal ahead of the host vehicle. The information related to the intersection of the traffic signal may be coordinates of a center point of the intersection, traffic regulation information related to the intersection, road shape information of the intersection, etc.

The meter display apparatus 3 includes a third information process apparatus 30, and a display part 32.

The third information process apparatus 30 is formed of a computer, as is the case with the first information process apparatus 10. The third information process apparatus 30 displays the red signal remaining time T1 or T2 on the display part according to the first output demand from the first information process apparatus 10 or the second output demand from the second information process apparatus 20. The third information process apparatus 30 displays, in a situation where the first output demand and the second output demand are generated simultaneously, for example, the red signal remaining time of one of the first output demand and the second output demand that is continuously generated earlier than the other.

It is noted that, in a situation where only one of the first output demand and the second output demand is generated, the third information process apparatus 30 basically displays the red signal remaining time of generated one of the first output demand and the second output demand. However, there may be an exception which is described hereinafter.

The display part 32 is provided in a meter. The display part 32 displays the red signal remaining time T1 or the red signal remaining time T2. A way of displaying the red signal remaining time T1 or red signal remaining time T2 on the display part 32 may be as disclosed in Patent Document 1, for example. The display part 32 may be replaced with other display part such as a HUD (Head-Up-Display).

Figure 2:
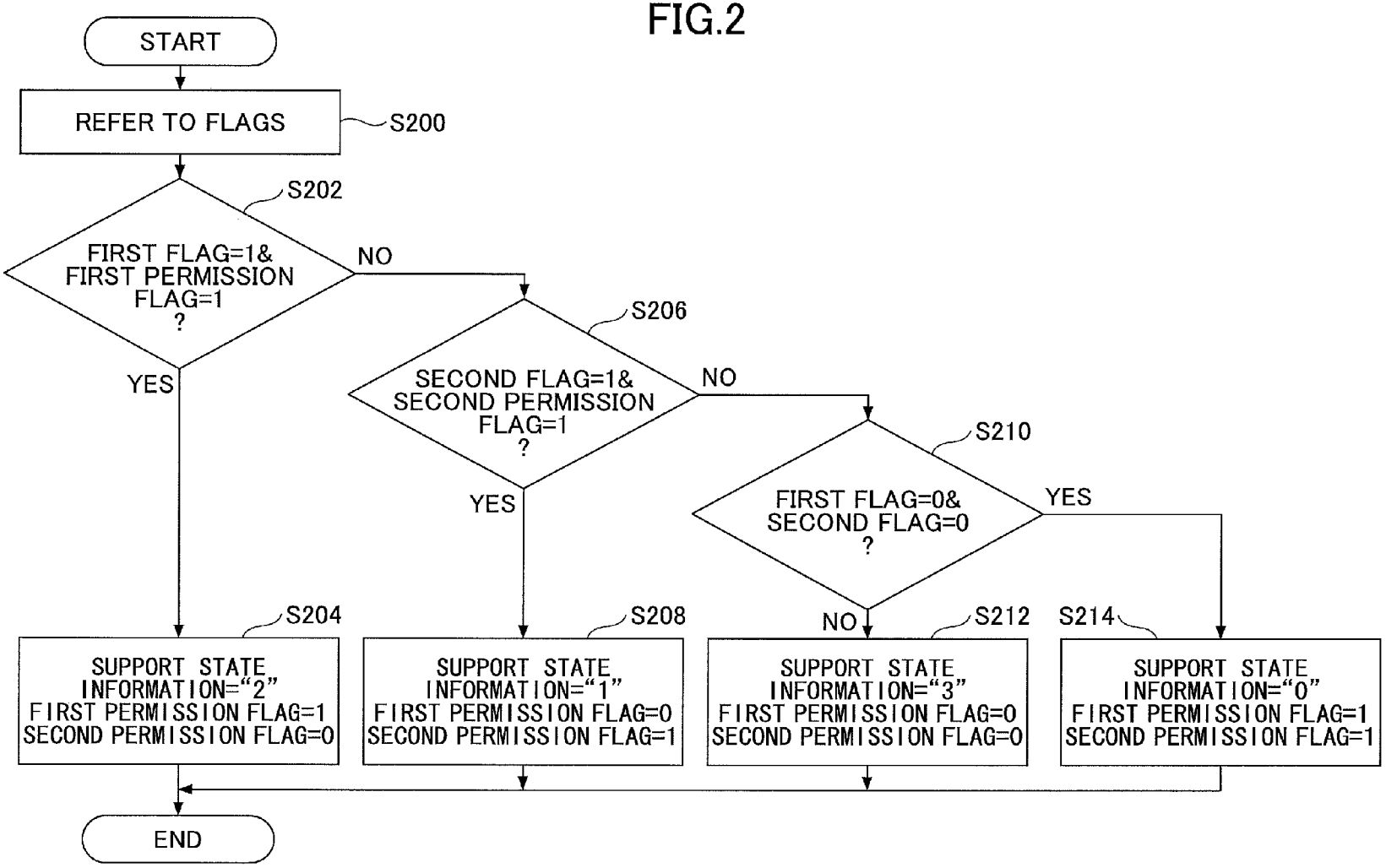
FIG. 2 is a flowchart schematically illustrating an example of a process of a third information process apparatus 30.

FIG. 2 is a flowchart schematically illustrating an example of a process of a third information process apparatus 30.

In step S200, the third information process apparatus 30 refers to flags. The flags to be referred are the first flag, the second flag, a first permission flag, and a second permission flag. The first permission flag represents whether to permit the output based on the red signal remaining time T1 related to the first output demand, in which "1" represents permitting the output and "0" represents preventing the output. The second permission flag represents whether to permit the output based on the red signal remaining time T1 related to the second output demand, in which "1" represents permitting the output and "0" represents preventing the output. The first and second permission flags have initial values "1", respectively. The first and second permission flags are initialized at service-out timing (a timing when a service section based on the received first and/or second traffic signal information ends, for example).

In step S202, the third information process apparatus 30 determines whether the first flag is equal to "1" and the first permission flag is equal to "1". If it is determined that the first flag is equal to "1" and the first permission flag is equal to "1", the process routine goes to step S204, otherwise process routine goes to step S206.

In step S204, the third information process apparatus 30 sets the support state information to "2", the first permission flag to "1", and the second permission flag to "0", respectively. The support state information being "2" means a state in which the output based on the red signal remaining time T1 related to the first output demand is performed. In this state, the third information process apparatus 30 displays the red signal remaining time T1 related to the first output demand on the display part 32.

In step S206, the third information process apparatus 30 determines whether the second flag is equal to "1" and the second permission flag is equal to "1". If it is determined that the second flag is equal to "2" and the second permission flag is equal to "1", the process routine goes to step S208, otherwise process routine goes to step S210.

In step S208, the third information process apparatus 30 sets the support state information to "1", the first permission flag to "0", and the second permission flag to "1", respectively. The support state information being "1" means a state in which the output based on the red signal remaining time T2 related to the second output demand is performed. In this state, the third information process apparatus 30 displays the red signal remaining time T2 related to the second output demand on the display part 32.

In step S210,the third information process apparatus 30 determines whether the first flag is equal to "0" and the second flag is equal to"0".If it is determined that the first flag is equal to "0" and the second flag is equal to "0",the process routine goes to step S214, otherwise process routine goes to step S212.

In step S212, the third information process apparatus 30 sets the support state information to "3", the first permission flag to "0", and the second permission flag to "0", respectively. The support state information being "3" means a state in which one of the first and second output demands is rejected. In this state, the third information process apparatus 30 does not display (i.e., does not output) the red signal remaining time on the display part 32.

In step S214, the third information process apparatus 30 sets the support state information to "0", the first permission flag to "1", and the second permission flag to "1", respectively. The support state information being "0" means a state in which neither the first output demand nor the second output demand is generated.

According to the process illustrated in FIG. 2, for example, in a situation where the first permission flag and the second permission flag are "1", the first flag is "0" and the second flag is "0", when the first flag is changed from "0" to "1", the determination result of step S202 becomes affirmative. Then, the process in step S204 causes the first permission flag to be set to "1" and the second permission flag to be set to "0". When the first permission flag is set to "1" and the second permission flag is set to "0", the process of step S204 is performed repeatedly at subsequent cycles even if the second flag is equal to "1", as long as the first flag is equal to "1". In other words, the second output demand is rejected, and the first output demand that is continuously generated from the earlier time point is selected with higher priority.

Similarly, for example, in a situation where the first permission flag and the second permission flag are "1", the first flag is "0" and the second flag is "0", when the second flag is changed from "0" to "1", the determination result of step S206 becomes affirmative. Then, the process in step S208 causes the first permission flag to be set to "0" and the second permission flag to be set to "1". When the first permission flag is set to "0" and the second permission flag is set to "1", the determination result of step S202 is negative and thus the process of step S208 is performed repeatedly at subsequent cycles even if the first flag is equal to "1", as long as the second flag is equal to "1". In other words, the first output demand is rejected, and the second output demand that is continuously generated from the earlier time point is selected with higher priority.

In this way, according to the process illustrated in FIG. 2, the third information process apparatus 30 can display the red signal remaining time of one of the first and second output demands that is continuously generated from the earlier time point. For example, the first output demand is generated first, and then the second output demand is generated, a state in which the first and second output demands are generated simultaneously is formed. It is noted that such a difference in timings may be generated due to a difference between the first traffic signal information and the second traffic signal information, a difference between the first output condition and the second output condition, etc. According to the process illustrated in FIG. 2, the third information process apparatus 30 can continue to display, even in a situation where the first output demand and the second output demand are generated simultaneously, the red signal remaining time of one of the first output demand and the second output demand that is continuously generated earlier than the other. With this arrangement, arbitration between the first and second output demands based on respective items of the traffic signal information from different infrastructures can be performed appropriately.

Here, for example, if the first output demand is generated first and then the second output demand is generated, which causes the first and second output demands to be generated simultaneously. Then, there may be a case in which the generation of the first output demand ends but the second output demand is still generated continuously. In such a case, if the display of the red signal remaining time T1 related to the first output demand is stopped due to the stop of the first output demand, and the display of the red signal remaining time T2 related to the second output demand is started in response to the second output demand, inconsistency occurs, which may cause the users to feel strange. In the following, permitting one of the first and second output demands immediately after a state in which the other is permitted ends is referred to as "inhering between different output demands".

According to the process illustrated in FIG. 2, once the first permission flag is set to "1" and the second permission flag is set to "0" in step S204, for example, the second output demand is rejected in step S206 even if the first flag is equal to "0" and the second flag is equal to "1" at the next cycle (step S212). Similarly, once the first permission flag is set to "0" and the second permission flag is set to "1" in step S208, for example, the first output demand is rejected in step S202 even if the first flag is equal to "1" and the second flag is equal to "0" at the next cycle (step S212). These rejected states are maintained until the first flag is equal to "0" and the second flag is equal to "0" ("YES" in step S210). With this arrangement, inhering between different output demands described above is suppressed, and inconvenience due to such inhering between different output demands described above can be reduced.

Figure 3:
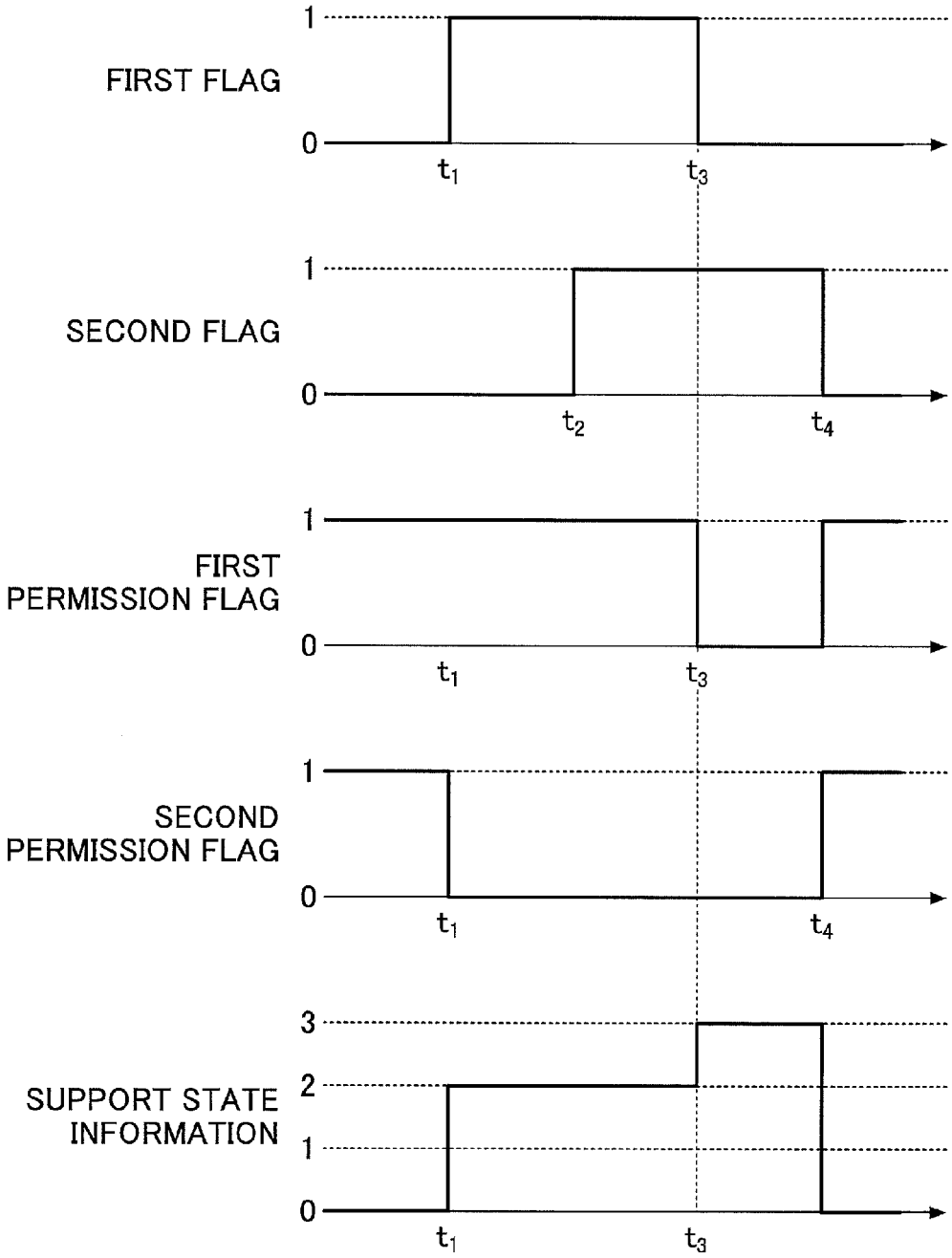
FIG. 3 is a timing chart illustrating an example of an operation illustrated in FIG. 2.

FIG. 3 is a timing chart illustrating an example of an operation illustrated in FIG. 2. In FIG. 3, from the upper side, a state of the first flag, a state of the second flag, a state of the first permission flag, a state of the second permission flag, and a state of the support state information are illustrated in time series.

In the example illustrated in FIG. 3, the first information process apparatus 10 sets the first flag to "1" at time point t1, and resets the first flag to "0" at time point t3. During the period in which the first flag is "1", the first information process apparatus 10 continues to generate the first output demand. Further, the second information process apparatus 20 sets the second flag to "1" at time point t2 and resets the second flag to "0" at time point t4. During the period in which the second flag is "1", the second information process apparatus 20 continues to generate the second output demand.

In the example illustrated in FIG. 3, the first flag is equal to "0" and the second flag is equal to "0" until the time point t1, and thus the first and second permission flags are equal to the initial values "1", respectively. Further, the support state information is equal to "0". Only the first output demand is generated at the time point t1, which causes the first and second permission flags to be set to "1" and "0", respectively, and causes the support state information to be set to "2". Accordingly, the third information process apparatus 30 starts to display the red signal remaining time related to the first output demand.

The second flag is set to "1" at the time point t2, but the first and second permission flags are "1" and "0", respectively, at the time point t2. Thus, the second output demand is rejected. A state in which the first output demand and the second output demand are generated simultaneously is formed from the time point t2 to the time point t3. In this state, the third information process apparatus 30 displays the red signal remaining time of one of the first and second output demands that is continuously generated from the earlier time point. In the example illustrated in FIG. 3, the first output demand is continuously generated from the time point t1, while the second output demand is continuously generated from the time point t2. Thus, the third information process apparatus 30 displays the red signal remaining time T1 related to the first output demand.

In this way, the third information process apparatus 30 continues to display the red signal remaining time T1 related to the first output demand from the time point t1 to the time point t3. It is noted that, during this period, the red signal remaining time T1 is updated, and thus the display related to the red signal remaining time T1 on the display part 32 is also updated.

The first flag is equal to "0" at the time point t3, but the second flag is equal to "1" at the time point t3. Thus, the first permission flag is set to "0" (step S212). A state in which the second flag is equal to "1" continues until the time point t4. Thus, a state in which the first and second permission flags are equal to "0" is maintained from the time point t3 to the time point t4, and the support state information is set to "3".

When the second flag becomes "0" at the time point t4, the first and second flags are equal to "0", and thus the first and second permission flags are reset to the initial value "1" (step S214). Further, the support state information is set to "0".

Figure 4:
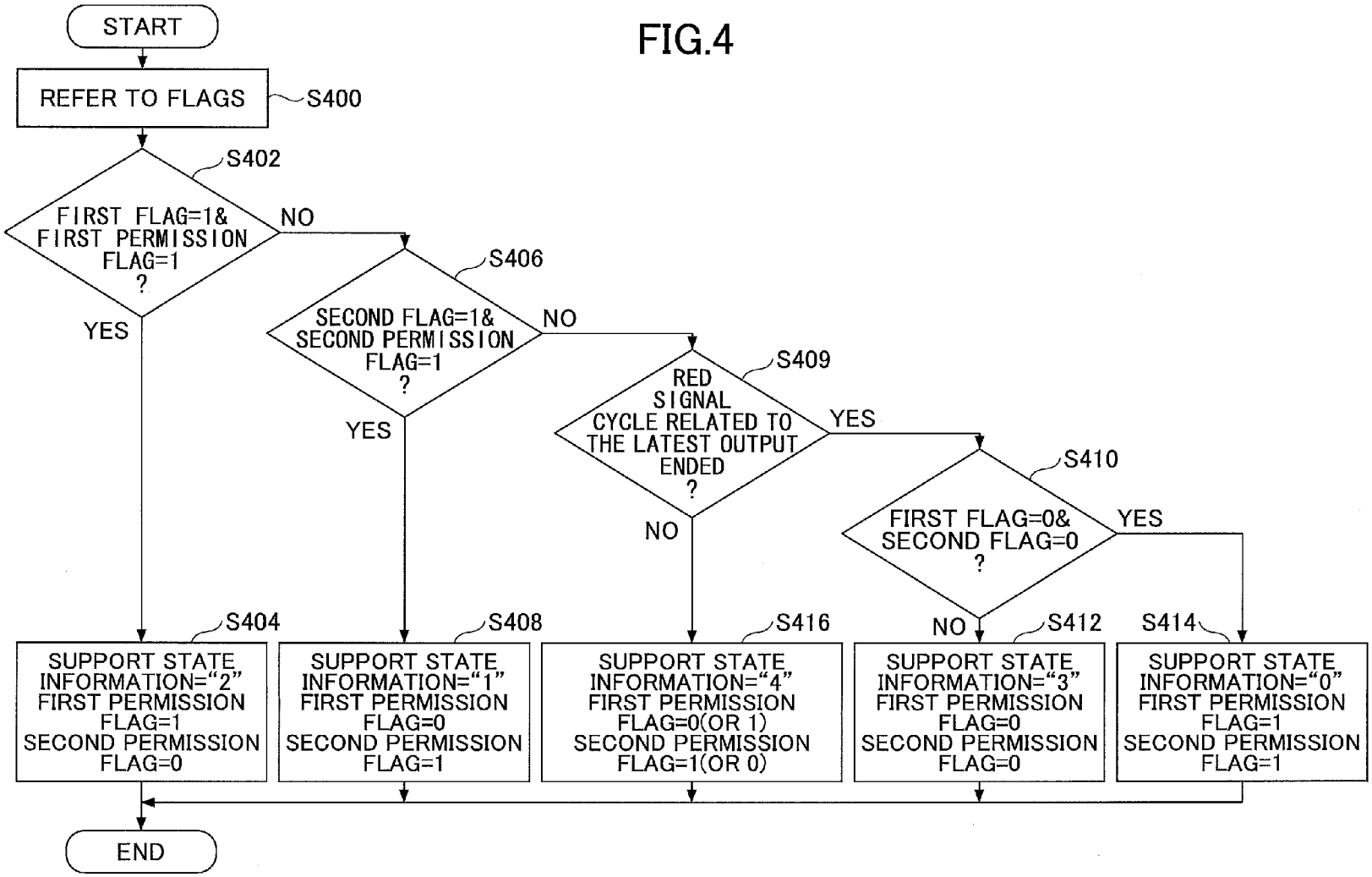
FIG. 4 is a flowchart schematically illustrating another example of a process of a third information process apparatus 30.

FIG. 4 is a flowchart schematically illustrating another example of a process of the third information process apparatus 30. The process illustrated in FIG. 4 differs from the process illustrated in FIG. 2 in that processes of steps S409 and S416 are added.

Processes from step S400 to step S408, and from step S410 to step S414 illustrated in FIG. 4 may be the same as the processes from step S200 to step S208, and from step S210 to step S214, respectively.

When the determination result of step S406 is negative, the process routine goes to step S409. In step S409, the third information process apparatus 30 determines whether the red signal cycle related to the latest output ends. The latest output is the output of the red signal remaining time based on the first output demand or the second output demand. For example, the third information process apparatus 30 determines that the red signal cycle ends when the red signal remaining time related to the latest output becomes 0. However, with respect to the latest output, if one of the first and second output demands is rejected, the third information process apparatus 30 determines whether the longer of the red cycle based on the first traffic signal information and the red cycle based on the second traffic signal information ends. If it is determined that the red signal cycle related to the latest output ends, the process routine goes to step S410, otherwise process routine goes to step S416.

In step S416, the third information process apparatus 30 sets the support state information to "4", and maintains the current states of the first permission flag and the second permission flag. For example, if the current state of the first permission flag and the second permission flag is such that the first permission flag is equal to "0" and the second permission flag is equal to "1", the third information process apparatus 30 maintains the current state of the first permission flag and the second permission flag such that the first permission flag is equal to "0" and the second permission flag is equal to "1". Further, if the current state of the first permission flag and the second permission flag is such that the first permission flag is equal to "1" and the second permission flag is equal to "0", the third information process apparatus 30 maintains the current state of the first permission flag and the second permission flag such that the first permission flag is equal to "1" and the second permission flag is equal to "0". The support state information being "4" means a state in which the same red signal cycle is continued.

According to the process illustrated in FIG. 4, the following effects, in addition to the effects described above and related to the process illustrated in FIG. 2, are obtained.

According to the process illustrated in FIG. 4, it becomes possible to suppress a problem that the output related to the first output demand as well as the output related to the second output demand are performed for the same red signal cycle at shifted timings. Specifically, for example, the first output demand is generated first, and then the first output demand ends due to the movement of the host vehicle. After that, the host vehicle stops again, and the second output demand is generated earlier than the current first output demand for the same red signal cycle as the previous first output demand. In such a case, if the display of the red signal remaining time T1 related to the first output demand is stopped due to the stop of the first output demand, and afterward the display of the red signal remaining time T2 related to the second output demand is started in response to the second output demand, inconsistency occurs, which may cause the users to feel strange. In the following, permitting one of the first and second output demands via a blank period (in which the output is not performed) after a state in which the other for the same red signal cycle is permitted ends is referred to as "intermittently inhering between different output demands for the same red signal cycle".

According to the process illustrated in FIG. 4, once the first permission flag is set to "1" and the second permission flag is set to "0" in step S404, for example, the state in which the first permission flag is equal to "1" and the second permission flag is equal to "0" is maintained in step S416 even if the state in which the first and second flags are equal to "0" is maintained afterward, until the red signal cycle related to the stopped first output demand ends. As a result of this, until the red signal cycle related to the first output demand ends, the determination result of step S406 is negative and thus the second output demand is rejected even if the second flag is set to "1" for that red signal cycle. In this way, the output based on the second output process is prevented. Similarly, once the first permission flag is set to "0" and the second permission flag is set to "1" in step S408, for example, the state in which the first permission flag is equal to "0" and the second permission flag is equal to "1" is maintained in step S416 even if the state in which the first and second flags are equal to "0" is maintained afterward, until the red signal cycle related to the stopped second output demand ends. As a result of this, until the red signal cycle related to the second output demand ends, the determination result of step S402 is negative and thus the first output demand is rejected even if the first flag is set to "1" for that red signal cycle. In this way, the output based on the first output process is prevented. In this way, according to the process illustrated in FIG. 4, "intermittently inhering between different output demands for the same red signal cycle" described above is suppressed, and inconvenience due to such "intermittently inhering between different output demands for the same red signal cycle" described above can be reduced.

Further, according to the process illustrated in FIG. 4, once the first permission flag is set to "1" and the second permission flag is set to "0" in step S404, for example, the state in which the first permission flag is equal to "1" and the second permission flag is equal to "0" is maintained in step S416 even if the state in which the first and second flags are equal to "0" is maintained afterward, until the red signal cycle related to the stopped first output demand ends. As a result of this, when the first flag is set to "1" again for the same red signal cycle before the red signal cycle related to the previous first output demand ends, the determination result of step S402 is affirmative and thus the first output demand is permitted. Similarly, once the first permission flag is set to "0" and the second permission flag is set to "1" in step S408, for example, the state in which the first permission flag is equal to "0" and the second permission flag is equal to "1" is maintained in step S416 even if the state in which the first and second flags are equal to "0" is maintained afterward, until the red signal cycle related to the stopped second output demand ends. As a result of this, when the second flag is set to "1" again for the same red signal cycle before the red signal cycle related to the previous second output demand ends, the determination result of step S406 is affirmative and thus the second output demand is permitted. In this way, according to the process illustrated in FIG. 4, it becomes possible to suppress "intermittently inhering between different output demands for the same red signal cycle" described above, while enabling restating the output of the same output demand for the same red signal cycle.

Figure 5:
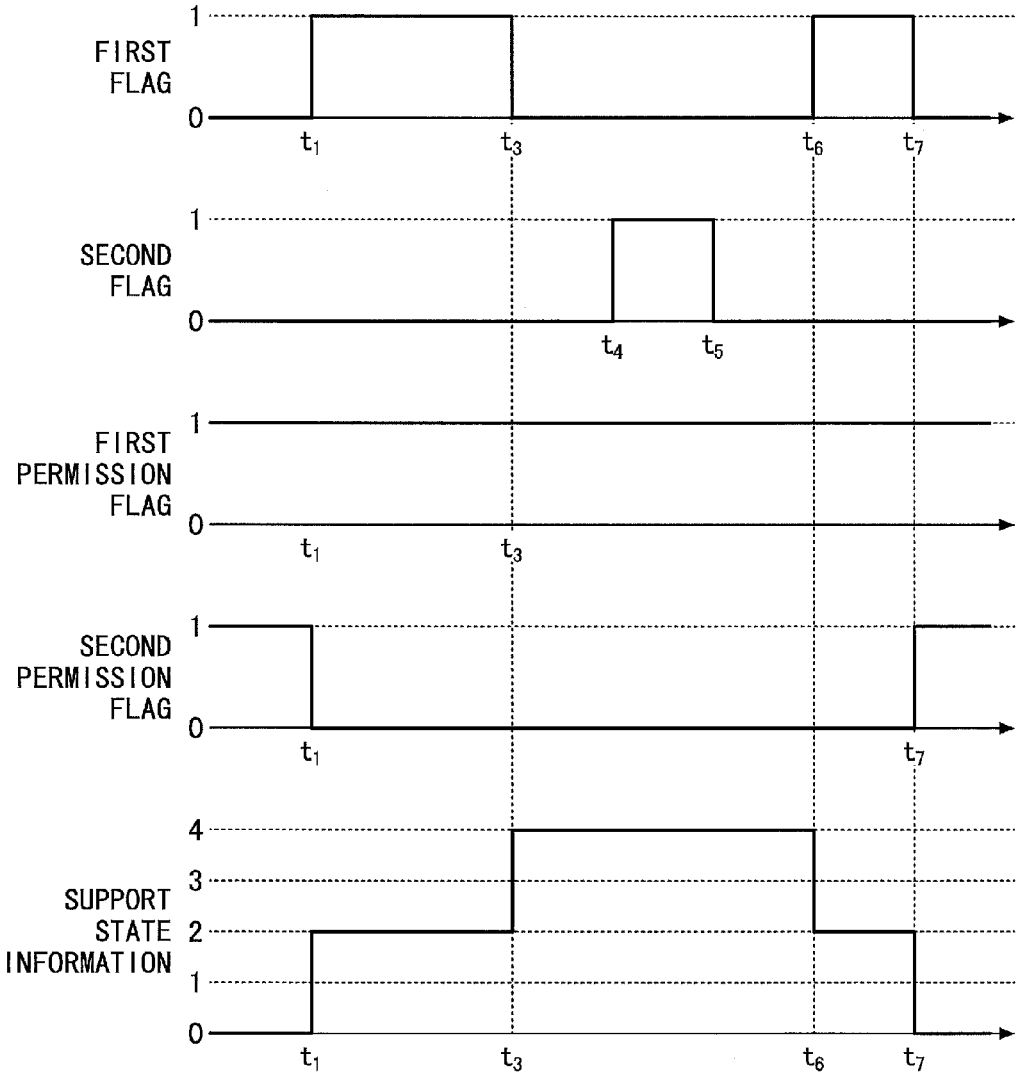
FIG. 5 is a timing chart illustrating an example of an operation illustrated in FIG. 4.

FIG. 5 is a timing chart illustrating an example of an operation illustrated in FIG. 4. In FIG. 5, from the upper side, a state of the first flag, a state of the second flag, a state of the first permission flag, a state of the second permission flag, and a state of the support state information are illustrated in time series.

In the example illustrated in FIG. 5, the first information process apparatus 10 sets the first flag to "1" at the time point t1, and resets the first flag to "0" at the time point t3. During the period in which the first flag is "1", the first information process apparatus 10 continues to generate the first output demand. Further, the second information process apparatus 20 sets the second flag to "1" at the time point t4 and resets the second flag to "0" at the time point t5. During the period in which the second flag is "1", the second information process apparatus 20 continues to generate the second output demand.

In the example illustrated in FIG. 5, the first flag is equal to "0" and the second flag is equal to "0" until the time point t1, and thus the first and second permission flags are equal to the initial values "1", respectively. Further, the support state information is equal to "0". Only the first output demand is generated at the time point t1, which causes the first and second permission flags to be set to "1" and "0", respectively, and causes the support state information to be set to "2". Accordingly, the third information process apparatus 30 starts to display the red signal remaining time related to the first output demand.

In the example illustrated in FIG. 5, a state in which only the first output demand is generated is formed from the time point t1 to the time point t3. The third information process apparatus 30 displays the red signal remaining time related to the first output demand. In this way, the third information process apparatus 30 continues to display the red signal remaining time T1 related to the first output demand from the time point t1 to the time point t3. It is noted that, during this period, the red signal remaining time T1 is updated, and thus the display related to the red signal remaining time T1 on the display part 32 is also updated. In this example, the red signal cycle related to the red signal remaining time T1 output in response to the first output demand from the time point t1 to the time point t3 continues until time point t7.

At the time point t3, the first flag is set to "0", and thus the first flag is equal to 0 and the second flag is equal to 0. In the example illustrated in FIG. 5, since the red signal cycle related to the red signal remaining time T1 output in response to the first output demand from the time point t1 to the time point t3 continues until the time point t7, the state in which the first permission flag is equal to 1 and the second permission flag is equal to 0 is kept (step S416). Thus, the support state information is set to "4". This state is maintained until time point t6.

At the time point t4, the second flag is set to "1". On the other hand, the first flag is also set to "1" at the time point t6 after the time point t4. Since the first permission flag is equal to 0 and the second permission flag is equal to 0 at the time point t4, On the other hand, since the first permission flag is equal to 0 and the second permission flag is equal to 0 at the time point t6, the first output demand is permitted. Further, the support state information is set to "2". In this way, the third information process apparatus 30 restarts the output, which has been stopped at the time point t3, in response to the first output demand at the time point t6. In other words, the third information process apparatus 30 starts to display the red signal remaining time T1 related to the first output demand again at the time point t6.

The first flag is kept at 1 from the time point t6 to the time point t7. The third information process apparatus 30 displays the red signal remaining time related to the first output demand from the time point t6 to the time point t7. In this way, the third information process apparatus continues to display the red signal remaining time T1 related to the first output demand from the time point t6 to the time point t7. It is noted that, during this period, the red signal remaining time T1 is updated, and thus the display related to the red signal remaining time T1 on the display part 32 is also updated.

At the time point t7, the red signal cycle related to the red signal remaining time T1 output in response to the latest output demand (i.e., the first output demand) ends. Thus, when the first flag becomes "0" at time point t7, the first and second flags are equal to "0", and thus the first and second permission flags are reset to the initial value "1" (step S414). Further, the support state information is set to "0".

The present invention is disclosed with reference to the preferred embodiments. However, it should be understood that the present invention is not limited to the above-described embodiments, and variations and modifications may be made without departing from the scope of the present invention.

For example, according to the embodiments described above, the first, second and third information process apparatuses 10, 20 and 30 functions separately; however, a part of or all the functions may be unified, or a part of the respective functions may be further distributed.

Further, according to the embodiments described above, the remaining time of the red signal is displayed; however, a remaining time of the blue signal may be displayed. Also, in this case, arbitration between two output demands can be performed in substantially the same way as described above, though the output conditions are changed.

Further, according to the process illustrated in FIG. 2, as a preferred embodiment, the processes of step S210 and step S212 are performed; however, the processes of step S210 and step S212 may be omitted. This holds true for the processes of step S410 and step S412 illustrated in FIG. 4.

The present application is based on and claims the benefit of priority of Japanese Priority Application No. 2014-226319, filed on Nov. 6, 2014, the entire contents of which are hereby incorporated by reference.

What is claimed is:

1. A traffic signal state detection apparatus, comprising:

at least one processor configured to:

obtain first traffic signal information generated by a first infrastructure, the first traffic signal information at least including information representing when a change in a light state of a traffic signal will next occur, the traffic signal being located ahead of a host vehicle on which the traffic signal state detection apparatus is installed;

obtain second traffic signal information generated by a second infrastructure that is different from the first infrastructure, the second traffic signal information representing when the change in the light state of the traffic signal will next occur;

determine that one of the obtained first traffic signal information and the obtained second traffic signal information has higher priority;

calculate, based on the one of the first traffic signal information and the second traffic signal information that is determined to have higher priority, a remaining time, which is the time remaining before the light state of the traffic signal is changed; and output the calculated remaining time.

2. The traffic signal state detection apparatus of claim 1, wherein the processor is further configured to: prevent outputting of a remaining time that is calculated based on the other one of the one of the obtained first traffic signal information and the obtained second traffic signal information that has the higher priority.

3. The traffic signal state detection apparatus of claim 1, wherein the calculated remaining time is the remaining time until the state of the traffic signal is to be changed from a red light signal to a signal that is a color that is different than red, and the processor is further configured to: prevent outputting of a remaining time that is calculated based on the other one of the one of the obtained first traffic signal information and the obtained second traffic signal information that has the higher priority.

4. The traffic signal state detection apparatus of claim 1, wherein the calculated remaining time is the remaining time until the state of the traffic signal is to be changed from a red light signal to a signal that is a color that is different than red.

5. The traffic signal state detection apparatus of claim 1, wherein the first infrastructure is a road side apparatus.

6. The traffic signal state detection apparatus of claim 1, wherein the first infrastructure is a road side apparatus that includes a radio communication apparatus.

7. The traffic signal state detection apparatus of claim 1, wherein the first traffic signal information includes information that can identify a cycle of a red signal at the traffic signal.

8. The traffic signal state detection apparatus of claim 5, wherein the second infrastructure is a road side apparatus that is different than the road side apparatus that is the first infrastructure.

9. The traffic signal state detection apparatus of claim 1, wherein the second infrastructure is a road side apparatus that includes an optical beacon apparatus.

10. The traffic signal state detection apparatus of claim 1, wherein the first traffic signal information includes at least one of: coordinates of a center point of an intersection that the traffic signal is located at, traffic regulation information related to the intersection, and road shape information of the intersection.

11. The traffic signal state detection apparatus of claim 1, wherein the one of the first traffic signal information and the second traffic signal information that has been continuously generated from an earlier point in time is selected as the one of the first traffic signal information and the second traffic signal information that has the higher priority.

* * * * *